US005637195A

United States Patent [19]

Foster

[11] Patent Number: 5,637,195

[45] Date of Patent: Jun. 10, 1997

[54] METHOD TO REDUCE OFF-TASTE AND/OR ODOR FROM HYGIENIC PAPER PACKAGES

[75] Inventor: James J. Foster, Clifton Forge, Va.

[73] Assignee: Westvaco Corporation, New York, N.Y.

[21] Appl. No.: 408,950

[22] Filed: Mar. 23, 1995

[51] Int. Cl.[6] ..... B05D 3/02

[52] U.S. Cl. ..... 162/135; 162/207; 427/377; 427/378; 427/382

[58] Field of Search ..... 162/51, 136, 135, 162/201, 205, 206, 20, 100; 422/5, 26; 427/33.2, 37.7, 378, 382

[56] References Cited

U.S. PATENT DOCUMENTS

| | | | |
|---|---|---|---|
| 2,116,544 | 5/1938 | Schur | 162/206 |
| 3,361,618 | 1/1968 | McKinley | 162/51 |
| 3,874,997 | 4/1975 | Kankaanpaa | 162/290 |
| 4,242,808 | 1/1981 | Luthi | 162/207 |
| 4,818,342 | 4/1989 | Wagle et al. | 162/206 |
| 4,828,650 | 5/1989 | Wagle et al. | 162/207 |
| 4,899,461 | 2/1990 | Lehtinen | 34/13 |
| 4,976,820 | 12/1990 | Laapotti | 162/206 |
| 5,120,400 | 6/1992 | Laapotti | 162/206 |
| 5,163,364 | 11/1992 | Bubik et al. | 100/38 |
| 5,223,099 | 6/1993 | Salo | 162/207 |
| 5,245,920 | 9/1993 | Hess | 100/38 |
| 5,252,185 | 10/1993 | Ellis et al. | 162/206 |

OTHER PUBLICATIONS

D. Whitehead, Sources and Solutions to Flavor/Odor Problems in Plastic Packaging, 1985 Film Extrusion Short Course/TAPPI Seminar Notes, pp. 11–15.

D.M. Wyatt, Analytical Analysis of Tastes and Odors Imparted to Foods by Packaging Materials, 1985 Polymers, Laminations & Coatings Conference/TAPPI Proceedings, pp. 325–329.

L. Soderhjelm and S. Eskelinnen, Characterization of Packaging Materials with Respect to Taint and Odour 1985 Appita vol. 38, No. 3, pp. 205–208, Paper presented at the 38th Annual General Conference, Surfers Paradise, 1984.

V. Brodie, III, Taste Testing as it Relates to Resins, 1988 Polymers, Laminations and Coatings Conference/TAPPI Proceedings, pp. 511–517.

P. A. Tice and R. M. White, Odour and Taint in Printed Cartons, Mar. 1988 Folding Carton Industry, pp. 16, 18, 20.

M. W. Potts, S. L. Baker, M. H. Hansen, and M. M. Hughes, Relative Taste Performance of Plastics in Food Packaging, 1989 Polymers, Laminations and Coatings Conference/Quality Assurance: A review of 1989, pp. 433–438.

R. M. Podhajny, The Sources of Packaging Odors, Mar. 1992 Converting Magazine, pp. 32, 34, 36 & 38.

G. Ziegleder, E. Stojacic, and M. Lustenberger, Origin and Analysis of Tainting in Unprinted Cardboard, 1994 Verpackungs–Rundschau, No. 6, pp. 36–39.

S.L. Nolen, S.E. Swisher, J.N. Bays, & E.G. Zoeller, Map An Effective Odor Control Strategy, Sep. 1994 Chemical Engineering Progress, pp. 47–53.

J.W. Appling and B.F. Shema, The Lethal Effect of Drier Rolls Upon Bacteria, Mar. 26, 1942, Tappi Section, pp. 152–156.

J.W. Appling, The Bacteriological Examination of Paper, Feb. 8, 1945, Tappi Section, pp. 50–56.

J.P. Casey, Pulp and Paper Chemistry and Chemical Technology, vol. 11: Papermaking, 1960, Interscience Publishers, Inc., pp. 905–911.

W.A. Wink, K.L. Hackley, and R. F. Tyler, Blistering of Paper During Heat Set Printing, Jul. 1967, Tappi, pp. 102A–108A.

R. Whittaker, Coated Paper and Heat Set Web Offset, Jan., 1968, The Paper Maker, pp. 44, 46 & 62.

J.W. Boyes and R. G. Adams, Solving Offset Problems Coated Papers May Create, Mar., 1969, Inland Printer/American Lithographer, pp. 41–45.

J.A. Perry, Web–Offset Printing Papers, May 1972, Tappi, pp. 722–728.

L. G. Rogerson, Paper Properties and Their Influence on Printing Processes and Print Reproduction, Nov. 1980, Paper Southern Africa, pp. 7, 8 and 11.

W. H. Bureau, Paper—A Papermaker's View of Web Offset, May 1983, Graphic Arts Monthly, pp. 143–144.

F. Franklin, Paper and Print—Blistering of Coated Papers, Mar. 1988, Paper Focus, p. 28.

K.A. Falter & U. Schmitt, Influence of Heat–Effects in Web Offset Printing on Strength Properties of the Paper and on Waviness of the Print, pp. 176–185.

Dr. Ing. Rolf Bosse; A Web Offset Printer's Dream has Come True; Polygraph 42–43.

F. Leslie; Development of a Laboratory Method for Fibre Roughening, Oct. 1992, Paper Technology, pp. 11–13.

McCall et al, "Superheated Steam Drying of Paper from Chemithermomechanical Pulp", *Tappi,* (Feb. 1994), vol. 77, No. 2, pp. 153–161.

*Primary Examiner*—Peter Chin
*Attorney, Agent, or Firm*—J. R. McDaniel; R. L. Schmalz

[57] ABSTRACT

This invention relates to a method for reducing off-taste and/or odor from hygienic paper packages (such as food and beverage packaging) by heating and steam stripping the surface of the paper web. Such methods of this type, generally, remove undesirable compounds that create off-taste and/or odor from the paper package in a simple, cost-effective manner.

2 Claims, 1 Drawing Sheet

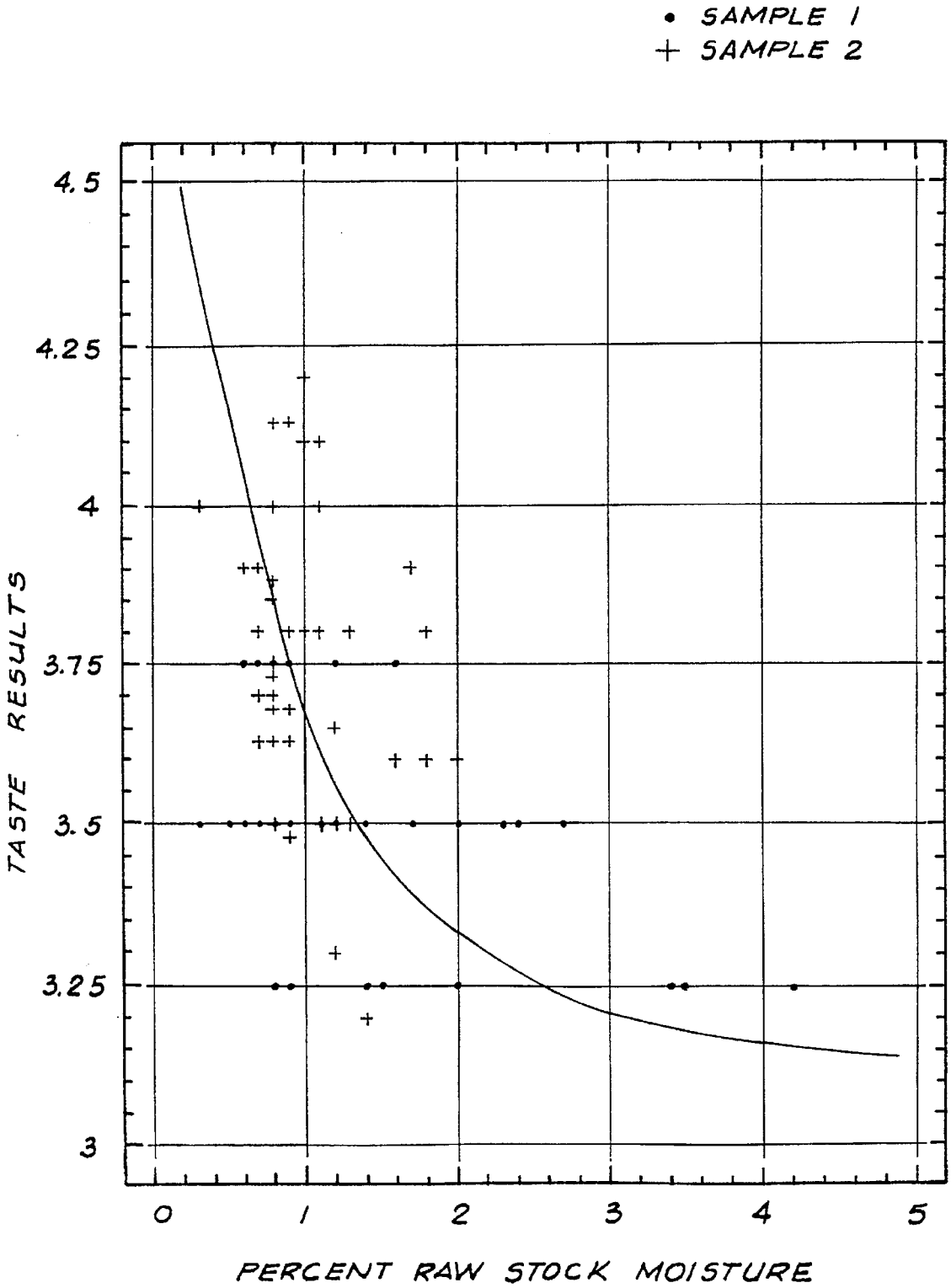
FIGURE

METHOD TO REDUCE OFF-TASTE AND/OR ODOR FROM HYGIENIC PAPER PACKAGES

BACKGROUND OF THE INVENTION

1. Field of the Invention

This invention relates to a method for reducing off-taste and/or odor from hygienic paper packages (such as food and beverage packaging). Such methods of this type, generally, remove undesirable compounds that create off-taste and/or odor from the paper package in a simple, cost-effective manner.

2. Description of Related Art

Packaging materials can impart a taste and/or odor to items contained inside. This is particularly a problem if the package is used for food products. The strong odor from the package can be absorbed by the food, thereby, making the food unpalatable.

The sources of the off-taste/odor are either the materials in printing the package (solvents, inks, etc.) or compounds of the package (paper, plastic coating, etc.). In many situations, printing materials are the predominate source of taste and/or odor in the package.

While there has been considerable work done in minimizing tastes/odors from the printing process, there has been minimal work on decreasing the taste from unprinted paper materials.

Taste and odor are subjective qualities. What may be objectionable to one person can be acceptable to another. This subjectiveness makes identifying the source of an off-taste/odor difficult. To further complicate identifying the source of the problem, taste and odor are rarely the result of a single chemical compound. Typically, it is a combination and/or interaction of multiple chemicals that results in a certain taste. For example, hundreds of compounds have been detected in coffee and are responsible for its characteristic taste and odor. To limit the subjectivity, odor and taste panels are used to evaluate a product.

While certain inorganic materials have a strong taste or odor (ammonia or hydrogen sulfide) most odors are due to organic compounds. Of the organic compounds, humans have more taste/odor sensitivity towards oxygenated compounds. For example, the average odor threshold for n-butane is 1000 ppm while for butyric acid it is 0.0001 ppm. This is also the reason most perfumes are esters. This is also the reason ketones give distilled spirits their characteristic taste. Another characteristic of odor causing compounds is their volatility.

As mentioned earlier, many off-taste/odor problems are due to solvents and materials used in the printing operations. However, there are several compounds in unprinted paper packaging that will affect the taste such as Octenol, Hexanal, Butyric acid, etc. These compounds are likely inherent to the papermaking process and are probably the result of the chemical reactions that occur in the pulping and/or bleaching process.

Prudence dictates that the best way to minimize off-taste/odor is to prevent it from occurring. For example, in the papermaking process, volatile fatty acids are apparently formed by microbiological fermentation. The fermentation occurs mainly in the holding tanks and the papermachine forming section ("wet end"). Fermentation can be minimized by adding biocides or slimicides at specific points in the pulp and papermaking process. By eliminating/minimizing the microbiological contamination present, the fatty acids are precluded from forming.

Similarly with the printing process, it is preferable to prevent them from occurring instead of treating them. For example, one can use low odor inks and varnishes in the printing process thereby avoiding some of the problems in the printing area. Similarly, one can use a solvent that does not contain high boiling residues ("tails") which can cause an odor.

Another solution used in the printing industry is to operate the printing process so that the solvent retained in the paper is low. Low solvent retention is achieved by increasing the temperature and/or time in the drying hoods. Exemplary of such prior art is U.S. Pat. No. 4,818,342 ('342) to D. G. Wagle et al., entitled "Heat Treatment of Paper Products". While the '342 patent describes a method for which the paper is dried to an extremely low moisture content then rewet, care must be exercised because if the paper is "over dried", the physical properties of the paper deteriorate and the print quality decreases. This "over drying" causes embrittlement of the paper and affects the ink's absorption properties.

Plastic and extruded paperboard also can be a source of off-taste/odors. For example, it is well recognized in the industry that extruding at higher temperatures increases the likelihood of forming an off-taste. In this instance, the problem is corrected by lowering the extruder die temperature.

Previous work suitable for use with unprinted packaging focused on absorption to reduce the concentration of compounds that generate off-taste and/or odor. The absorption is accomplished by adding aluminum silicate to the pulp going to the wet end of the paper machine. Typical addition rates are 0.5–2 kg/ton. While this may be a solution to the off-taste/odor problem it has several drawbacks. One drawback is that the effectiveness is dependent on the retention of the aluminum silicate in the paper fiber. If there is naturally poor retention, then additional chemicals must be used to promote adhesion of the aluminum silicate onto the paper fibers. Also, this does not eliminate the compounds causing taste and odor problems, it merely adsorbs them.

It is apparent from the above that there exists a need in the art for a method which reduces off-taste and/or odor from a paper package, and which at least equals the off-taste/odor removal characteristics of the known techniques, but which at the same time substantially removes the off-taste and/odor in a simple, cost-effective manner. It is the purpose of this invention to fulfill this and other needs in the art in a manner more apparent to the skilled artisan once given the following disclosure.

SUMMARY OF THE INVENTION

Generally speaking, this invention fulfills these needs by providing a method for reducing off-taste and/or odor from a paper package, comprising the steps of: constructing a paper web; heating a surface of said paper web to a temperature greater than 100° C.; and removing moisture from said paper web such that a residual moisture content within said paper web is less than 5 percent whereby off-taste and/or odor from said paper web is reduced.

In certain preferred embodiments, the heating of the surface of the paper web is accomplished between the press section at the wet end of the paper machine and the first operation that applies coating, sizing or the like to the paper web. Also, the preferable residual moisture content is less than 4 percent.

In another further preferred embodiment, the off-taste and/or odor from the paper package is reduced by the method of the present invention in a simple, cost-effective manner.

The preferred method, according to this invention, offers the following advantages: reduced off-taste in the paper; reduced odor in the paper; ease of reduction of off-taste and/or odor; and excellent economy. In fact, in many of the preferred embodiments, these factors of reduced off-taste, reduced odor, ease of reduction of off-taste and/or odor and economy are optimized to the extent that is considerably higher than heretofore achieved in prior, known off-taste and/or odor reduction methods.

BRIEF DESCRIPTION OF THE DRAWING

The subject matter which is regarding as the invention is particularly pointed out and distinctly claimed in the concluding portion of the specification. The invention, however, may be best understood by reference to the following description taken in conjunction to the accompanying drawing FIGURE which is a graphical illustration of taste value versus percent raw stock moisture, according to the present invention.

DETAILED DESCRIPTION OF THE INVENTION

Most solutions described above are designed to prevent, not alleviate, additional off-taste/odor from being introduced into the packaging material. For example, using low odor inks and varnishes reduces the risk of having an ink taste in the package and proper use of a biocide can prevent the formation of fatty acids. While for many food packaging applications this may be sufficient, there are certain items that are very sensitive to packaging odors. Examples of such foods include water, chocolate, certain fruit juices, etc. While not a food stuff, tobacco is another product packaged in paperboard that is very sensitive to odors. For these items, the paper packaging must produce little or no odor. The use of aluminum silicate is designed to alleviate odors however, it does have some drawbacks which were described previously.

For these types of hygienic packaging and other applications where low odor is desirable (i.e. perfume packaging), this invention was developed. The invention actively treats the paper to remove various compounds inherent in the pulp and papermaking process that may cause off-taste/odor. Also, this process is capable of removing impurities in chemicals added to the pulp and papermaking process. To remove these odoriferous compounds, the present invention requires the heating of the surface of paper web during certain portions of the paper forming process to a temperature in excess 100° C. and to a very low average moisture content.

In the preferred embodiment, the heating occurs prior to the size press operation and the sheet is dried until the average moisture is less than 2 percent and, ideally, less than 1 percent. The drying to a low moisture can also occur concurrently in the drying section after the size press and prior to the coating operations. In this case, the summation of the residual average moistures prior to the size press and prior to the coating operations should be less than 5 percent and, preferably, less than 4.

It is theorized that the removal of odoriferous compounds during this particular section of the papermaking process occurs by a combination of evaporation of low volatility compounds and removal by "steam stripping". Steam stripping is a process in which steam is passed through a mixture and the steam soluble components are removed. This method of separation is employed in removing essential oils (typically, odoriferous) from plant materials. By using this process, compounds with boiling points greater than 100° C. can be separated by using a combination of heat and solubility. In papermaking, the steam is generated by heating the wet paper web on the steam heated drying cans.

While it is typical to dry the sheet on the paper machine, drying down to these moisture concentrations is not usually done, or if it is done, it is by happenstance and not for the reason to remove odoriferous compounds. This is especially true with the thicker paperboard used in packaging. When running thicker paperboard, the drying performed prior to the size press limits the speed of the paper machine, and, therefore, limits production. Consequently, the drying in this section may not be as complete as with other sections on the paper machine.

While in some circumstances, it is obvious that volatile compounds can be driven off by heating, it is not obvious in the case of paper. As stated above, the physical and printing properties of paper are very dependant on moisture content. Therefore, care must be taken whenever you change the moisture content. The advantage with the present invention is that final sheet moisture of the paper (typically, 5 percent) can be obtained in the subsequent machine processes such as the coating operations and the gloss calender roll. Furthermore, heating of the completed paper product will not result in the same steam stripping efficiencies as discussed earlier in the process because of the vapor barrier properties of the size and the coating.

Trials were conducted on a papermaking machine. In these trials, the moisture before the size press (raw stock) was targeted at less than 2 percent and, preferably, less than one percent. Finished paperboard samples (Samples 1 and 2) were subjected to a taste panel for analysis. The grading system used by the panel is a modification of a conventional one. In the grading system of the present invention, 5 equals no taste, 4 equals a weak taste and 3 equals a strong taste. Thus, it is desirable to have a high number for the taste value.

The results of the taste analysis are shown on the FIGURE, The graph of the FIGURE shows scatter but that is to be expected because of the subjective and complicated nature of taste analysis. The graph does show the general trend in that low moisture results in higher taste results (less taste) while high moisture has the opposite effect.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for reducing off-taste and/or odor from a paper package, wherein said method is consisting essentially of the steps of:

constructing a paper web;

heating a surface of said paper web to a temperature greater than 100° C. wherein said heating step is further comprised of steam stripping said surface of said paper web;

removing moisture from said paper web such that a residual moisture content within said paper web is less than 2 percent whereby off-taste and/or odor from said paper web is reduced;

coating said paper web; and producing a paper package from said paper web.

2. The method, as in claim 1, wherein a summation of residual moisture prior to a size press and prior to a coating operation is less than 5 percent.

* * * * *